US007827705B2

(12) United States Patent
Baucom et al.

(10) Patent No.: US 7,827,705 B2
(45) **Date of Patent: *Nov. 9, 2010**

(54) ARTICLE OF FOOTWEAR WITH MULTIPLE CLEAT SIZES

(75) Inventors: Jim Baucom, Portland, OR (US); Jon Ervin, Gaston, OR (US); Clifford B. Gerber, West Linn, OR (US); Erez Morag, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 807 days.

This patent is subject to a terminal disclaimer.

(21) Appl. No.: 11/683,965

(22) Filed: Mar. 8, 2007

(65) Prior Publication Data

US 2008/0216352 A1 Sep. 11, 2008

(51) Int. Cl.
*A43B 5/00* (2006.01)

(52) U.S. Cl. ..... 36/59 R; 36/67 R; 36/134

(58) Field of Classification Search ..... 36/67 A, 36/59 C, 127, 134, 107, 108; D2/954, 955
See application file for complete search history.

(56) References Cited

U.S. PATENT DOCUMENTS

| | | | |
|---|---|---|---|
| 444,735 | A | 1/1891 | Thomas |
| 1,484,785 | A | 2/1924 | Hiss |
| 1,848,518 | A | 3/1932 | Doran et al. |
| 2,129,424 | A | 9/1938 | Jay |
| 2,179,124 | A | 11/1939 | Jesnig |
| 3,043,025 | A | 7/1962 | Semon |
| 3,054,197 | A | 9/1962 | Morgan et al. |
| 3,341,952 | A | 9/1967 | Dassler |
| 3,410,005 | A | 11/1968 | Szerenyi |
| 3,988,840 | A | 11/1976 | Minihane |
| 3,999,558 | A | 12/1976 | Barnwell et al. |
| 4,014,114 | A | 3/1977 | Jordan et al. |
| 4,083,126 | A | 4/1978 | Pelletier |
| 4,167,071 | A | 9/1979 | Koransky |
| 4,178,702 | A | 12/1979 | Mayer |
| 4,233,759 | A | 11/1980 | Bente et al. |
| 4,316,335 | A | 2/1982 | Giese et al. |
| 4,318,232 | A | 3/1982 | Ching |
| 4,327,503 | A | 5/1982 | Johnson |
| 4,494,320 | A | 1/1985 | Davis |

(Continued)

FOREIGN PATENT DOCUMENTS

| | | | |
|---|---|---|---|
| DE | 4417563 | A1 | 11/1995 |
| EP | 1002473 | A1 | 5/2000 |

OTHER PUBLICATIONS

Photograph of "Nike Air Zoom Brasilian MG" shoes that were introduced to the public in Spring, 2006.
Office Action for U.S. Appl. No. 11/683,967 mailed on Dec. 17, 2009.

*Primary Examiner*—Jila M Mohandesi
(74) *Attorney, Agent, or Firm*—Plumsea Law Group, LLC

(57) ABSTRACT

An article of footwear including different cleat sizes is disclosed. The article of footwear includes cleats of a first size along the medial side of the outsole and cleats of a second size along the lateral side of the outsole. The cleats also include spherical indentations along their tips. The outsole also includes an internal structural plate with notches associated with the cleats.

20 Claims, 8 Drawing Sheets

U.S. PATENT DOCUMENTS 4,524,531 A 6/1985 VanDeripe
4,597,196 A 7/1986 Brown
4,769,931 A 9/1988 Morrow et al.
4,787,156 A 11/1988 Bade
4,803,747 A 2/1989 Brown
D303,871 S * 10/1989 Driscoll ..... D2/955
4,875,683 A 10/1989 Wellman et al.
D318,946 S * 8/1991 Granatelli ..... D2/955
5,052,130 A 10/1991 Barry et al.
5,077,916 A 1/1992 Beneteau
5,311,680 A 5/1994 Comparetto
5,452,526 A 9/1995 Collins
5,473,827 A 12/1995 Barre et al.
5,853,844 A 12/1998 Wen
5,901,472 A 5/1999 Adam
D410,965 S 6/1999 Schuette et al.
5,915,820 A 6/1999 Kraeuter et al.
5,943,794 A * 8/1999 Gelsomini ..... 36/127
6,016,613 A * 1/2000 Campbell et al. ..... 36/59 C
D433,213 S 11/2000 Schuette et al.
6,167,641 B1 1/2001 McMullin
6,199,303 B1 3/2001 Luthi et al.
D440,032 S * 4/2001 Madden ..... D2/954
D445,561 S * 7/2001 Bramani ..... D2/954
D446,917 S 8/2001 Brown
6,354,022 B2 * 3/2002 Gelsomini ..... 36/127
6,381,878 B1 5/2002 Kennedy, III et al.
6,421,933 B1 7/2002 Zamprogno
6,434,860 B1 8/2002 Turos
6,467,196 B1 10/2002 Koyama
6,477,791 B2 11/2002 Luthi et al.
6,502,330 B1 1/2003 David et al.
D471,698 S 3/2003 Brown
6,543,160 B2 4/2003 Price
D481,201 S * 10/2003 Shea et al. ..... D2/954
6,647,647 B2 11/2003 Auger et al.
6,857,205 B1 2/2005 Fusco et al.
6,910,287 B2 6/2005 Truelsen
6,915,598 B2 7/2005 Grisoni et al.
6,954,998 B1 10/2005 Lussier
7,007,410 B2 3/2006 Auger et al.
7,100,309 B2 * 9/2006 Smith et al. ..... 36/28
7,143,530 B2 * 12/2006 Hudson et al. ..... 36/128
D539,516 S * 4/2007 McClaskie ..... D2/955
2004/0163282 A1 8/2004 Pan
2005/0097782 A1 5/2005 Mills et al.

* cited by examiner

ARTICLE OF FOOTWEAR WITH MULTIPLE CLEAT SIZES

BACKGROUND OF THE INVENTION

1. Field of the Invention

The present invention relates generally to articles of footwear and in particular to footwear with multiple cleat sizes.

2. Description of Related Art

Articles of footwear with more than one cleat size have been previously proposed. Johnson (U.S. Pat. No. 4,327,503) teaches an outer sole structure for an athletic shoe with molded cleats of two different types. The cleats of the first type are disposed around the periphery of the sole and the cleats of the second type are primarily disposed in the remaining portions of the sole. Each of the first cleats has three surfaces extending outward from a major exterior surface of the outsole to a flat crown that is parallel to the major exterior surface. The second cleats are generally conical in shape and extend outwardly from the sole to about half the height of the first cleats.

Minihane (U.S. Pat. No. 3,988,840) also teaches a shoe where more than one type of cleat is provided. In particular, Minihane teaches a structure having cleats of two different types including uniformly spaced frustoconical cleats in the ball and heel areas and spaced peripheral cleats at the edges of the sole. In the Minihane design, the peripheral cleats are generally shorter than the frustoconical cleats.

While the prior art teaches articles of footwear including multiple cleat sizes, the prior art does not teach different sized cleats disposed along the lateral and medial sides. Additionally, the prior art teaches generally flat cleats that conform to a planar surface. The prior art does not teach cleats that are contoured to a curved surface in the forefoot area. Furthermore the prior art does not teach cleats including indented cleat tips.

SUMMARY OF THE INVENTION

An article of footwear including multiple cleat sizes is disclosed. In one aspect, the invention provides, an article of footwear including an outsole, comprising: a first portion including a medial side and a lateral side; a first group of cleats having a first size and a second group of cleats having a second size; and where the first group is associated with the medial side of the first portion and the second group is associated with the lateral side of the first portion.

In another aspect, the first size is smaller than the second size.

In another aspect, there is a third group of cleats.

In another aspect, there is a fourth group of cleats.

In another aspect, the fourth group of cleats has a size smaller than the first group of cleats and the second group of cleats.

In another aspect, the third group of cleats is larger than the first group of cleats and the second group of cleats.

In another aspect, the invention provides an article of footwear including an outsole, comprising: a first portion of the outsole including an outer surface; a first group of cleats disposed along the outer surface, each cleat including a base portion and a tip portion; a second surface formed by the tip portions of the first group of cleats; and where the second surface is substantially congruent to the outer surface of the first portion.

In another aspect, the outsole includes a second group of cleats disposed along the outer surface, each cleat including a base portion and a tip portion.

In another aspect, a third surface is formed by the tip portions of the second group of cleats.

In another aspect, the third surface is substantially congruent to the outer surface of the first portion.

In another aspect, each cleat of the first cleat group includes an indentation.

In another aspect, the indentation is spherical.

In another aspect, the outsole includes a third cleat group and a fourth cleat group.

In another aspect, the invention provides an article of footwear including an outsole, comprising: at least one cleat disposed along an outer surface of the outsole; an internal structural plate disposed along a central portion of the outsole; the internal structural plate including at least one notch; and where the at least one notch is disposed above the at least one cleat.

In another aspect, the outsole includes multiple cleats disposed along the outer surface.

In another aspect, the outsole includes a first cleat group and a second cleat group.

In another aspect, the first cleat group is smaller than the second cleat group.

In another aspect, the internal structural plate includes notches associated with the multiple cleats.

In another aspect, the multiple cleats are associated with indentations.

In another aspect, the internal structural plate is constructed of nylon with a glass fill.

In another aspect, the invention provides an article of footwear including an outsole, comprising: an internal structural plate disposed along a central portion of the outsole; the internal structural plate including a first portion; and where the first portion includes a first projecting portion and a second projecting portion wherein a gap is disposed between the first projecting portion and the second projecting portion.

In another aspect, the outsole includes at least one cleat.

In another aspect, the internal structural plate includes at least one notch.

In another aspect, the at least one cleat is associated with the at least one notch.

In another aspect, the outsole includes multiple cleats.

In another aspect, each of the multiple cleats includes an indentation along a tip portion.

In another aspect, the indentation is spherical.

In another aspect, the invention provides an article of footwear including an outsole, comprising: a forefoot portion and a heel portion, the forefoot portion including an outer periphery and an inner portion; the outer periphery of the forefoot portion including a first cleat having a first diameter and a second cleat having a second diameter; the inner portion of the forefoot portion including a third cleat having a third diameter; and where the heel portion includes a fourth cleat having a fourth diameter.

In another aspect, the outer periphery of the forefoot portion includes eleven cleats.

In another aspect, the inner portion of the forefoot portion includes six cleats In another aspect, the heel portion includes four cleats In another aspect, the fourth diameter is larger than the first diameter, the second diameter and the third diameter.

In another aspect, the third diameter is smaller than the first diameter and the second diameter.

In another aspect, the cleats disposed along the inner portion of the forefoot portion are shorter than the cleats disposed along the outer periphery of the forefoot portion.

In another aspect, the cleats disposed along the heel portion are longer than the cleats disposed along the forefoot portion.

In another aspect, the invention provides, an article of footwear including an outsole, comprising: a first portion, the first portion including an outer periphery and an inner portion; the outer periphery including a first cleat having a first size; and where the outer periphery includes a second cleat having a second size.

In another aspect, the inner portion includes a third cleat.

In another aspect, the third cleat has a third size.

In another aspect, the first size is larger than the second size.

In another aspect, the third size is smaller than the first size and the second size.

In another aspect, the outsole includes a second portion.

In another aspect, the second portion is a heel portion.

In another aspect, the heel portion includes a fourth cleat having a fourth size.

In another aspect, the first portion is a forefoot portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
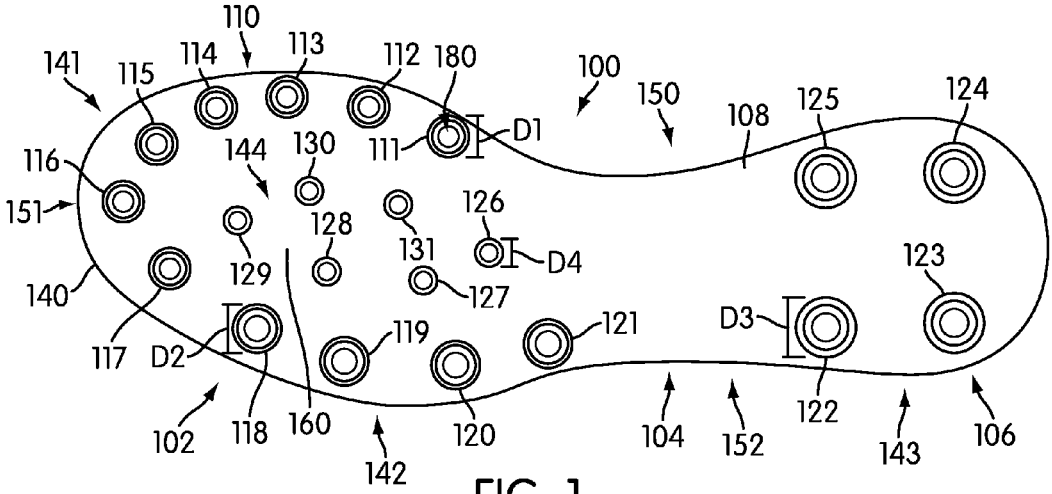
FIG. 1 is a plan view of a preferred embodiment of an outsole with a cleat system.

FIG. 1 is a plan view of a preferred embodiment of outsole 100 in the form of a football cleat outsole. For clarity, the following detailed description discusses a preferred embodiment, however, it should be kept in mind that the present invention could also take the form of any other kind of footwear outsole, including for example, a baseball cleat outsole, a soccer cleat outsole, or any other kind of footwear outsole that includes cleats.

In some embodiments, outsole 100 may be constructed of a lightweight and flexible material. In some embodiments, outsole 100 may be constructed of a plastic material. In a preferred embodiment, outsole 100 may be constructed of a plastic molding, such as Pebax® or other thermoplastic elastomers, thermoplastic polyurethane (TPU), or carbon fiber.

Outsole 100 preferably includes first portion 102, second portion 104 and third portion 106. In some embodiments, first portion 102 may be a forefoot portion. In some embodiments, second portion 104 may be an arch portion. In some embodiments, third portion 106 may be a heel portion. In other embodiments, outsole 100 may be divided into a different number of portions other than three.

Preferably, outsole 100 includes provisions for providing traction between the ground and bottom surface 108 of outsole 100. In some embodiments, outsole 100 may be associated with cleats. Generally, cleats may be configured to penetrate or interact with the ground, providing the user with a preconfigured amount of traction.

In some embodiments, outsole 100 may be associated with cleat system 110. Cleat system 110 preferably includes cleats 111-131. Generally, cleats 111-131 may be constructed of similar materials. The types of materials that may be used to construct cleats 111-131 include, but are not limited to plastic, metal, rubber, as well as other types of materials. In a preferred embodiment, cleats 111-131 may be constructed of a hard molded plastic.

Generally, cleat system 110 may be divided into multiple groups of cleats, with each cleat group sharing common characteristics such as cleat size. In some embodiments, cleat system 110 preferably includes first cleat group 141. Generally, first cleat group 141, including cleats 111-117, may be disposed along outer periphery 140 of first portion 102. Preferably, first cleat group 141 may be disposed along both medial side 150 and front side 151 of outsole 100. In this embodiment, first cleat group 141 includes seven cleats. In other embodiments, however, the number of cleats comprising first cleat group 141 may vary.

In some embodiments, cleat system 110 may also include second cleat group 142. Second cleat group 142, including cleats 118-121, may also be disposed along outer periphery 140 of first portion 102. Preferably, second cleat group 142 is disposed along a different portion of outer periphery 140 than first cleat group 141. In the embodiment shown in the figures, second cleat group 142 may be disposed along lateral side 152 of outsole 100. In this embodiment, second cleat group 142 includes four cleats. In other embodiments, however, the number of cleats comprising second cleat group 142 may vary.

In some embodiments, cleat system 110 may include third cleat group 143. Preferably, third cleat group 143, which includes cleats 122-125, may be disposed along third portion 106 of outsole 100. Generally, cleats 122 and 123 may be disposed along lateral side 152 of outsole 100, while cleats 124 and 125 may be disposed along medial side 150 of outsole 100. In this embodiment, third cleat group 143 includes four cleats. However, in other embodiments, the number of cleats comprising third cleat group 143 may vary.

In some embodiments, cleat system 110 may also include fourth cleat group 144. In a preferred embodiment, fourth cleat group 144, which includes cleats 126-131, may be disposed within inner portion 160 of first portion 102. Inner portion 160 is preferably a portion of outsole 100 that is disposed within outer periphery 140. In this embodiment, fourth cleat group 144 preferably includes six cleats. However, in some embodiments, the number of cleats comprising fourth cleat group 144 may vary.

Generally, cleat system 110 includes provisions for providing different types of traction and support along different regions of outsole 100. In some embodiments, these provisions may include using different sized cleats. In a preferred embodiment, each of the cleat groups 141-144 may include cleats that are a different size that the cleats of the other cleat groups.

In some embodiments, first cleat 111 of first cleat group 141 may have a first diameter D1. Preferably, the remaining cleats 112-117 of first cleat group 141 are constructed in a substantially similar manner to first cleat 111, and therefore cleats 112-117 may also have widths substantially similar to first diameter D1. Likewise, second cleat 118 of second cleat group 142 may have a second diameter D2. Preferably, the remaining cleats 119-121 of second cleat group 142 are constructed in a substantially similar manner to second cleat 118, and therefore cleats 119-121 may also have widths substantially similar to second diameter D2.

In a preferred embodiment, first diameter D1 may be smaller than second diameter D2. In other words, the cleats of first cleat group 141 may have a smaller width, or diameter, than the cleats of second cleat group 142. It can also be observed that outer periphery 140 can include cleats having different sizes.

Using the configuration described above, second cleat group 142 may provide more support to lateral side 152 of outsole 100 because of the larger diameter D2 associated with second cleat group 142. This may decrease the tendency of forefoot portion 102 to roll outwards and may decrease injuries to a user's foot. As first cleat group 141 may be associated with smaller diameter D1, first cleat group 141 may penetrate more quickly into a surface than second cleat group 142. This fast penetration allows for rapid changes in the direction of movement of the athlete. Also, in this manner, first cleat group 141 may provide forefoot portion 102 with additional traction along medial side 150 of outsole 100.

In some embodiments, third cleat 122 of third cleat group 143 may have a third diameter D3. Preferably, the remaining cleats 123-125 of third cleat group 143 are constructed to be substantially similar to third cleat 122, and therefore cleats 123-125 may have widths substantially similar to third diameter D3. Generally, third diameter D3 may be larger than first diameter D1 and second diameter D2. Preferably, third diameter D3 is the largest diameter associated with any of the cleat groups. With this configuration, third cleat group 143 preferably penetrates into a surface less than the remaining cleat groups. This provision preferably gives the user some traction along the heel, but prevents the user's heel from sinking too deep into a surface.

In some embodiments, fourth cleat 126 of fourth cleat group 144 may have a fourth diameter D4. Preferably, the remaining cleats 127-131 of fourth cleat group 144 are constructed to be substantially similar to fourth cleat 126, and therefore cleats 127-131 may have widths substantially similar to fourth diameter D4. Generally, fourth diameter D4 may be smaller than diameters D1, D2 and D3. Using this configuration, primary support for first portion 102 of outsole 100 may be directed to outer periphery 140. This arrangement, of providing smaller cleats in inner portion 160 than outer periphery 140, helps to prevent the forefoot portion, or first portion 102, from penetrating too deeply into the ground. This can help to reduce the amount of extraction force necessary to remove or lift the article of footwear from the ground.

Figure 2:
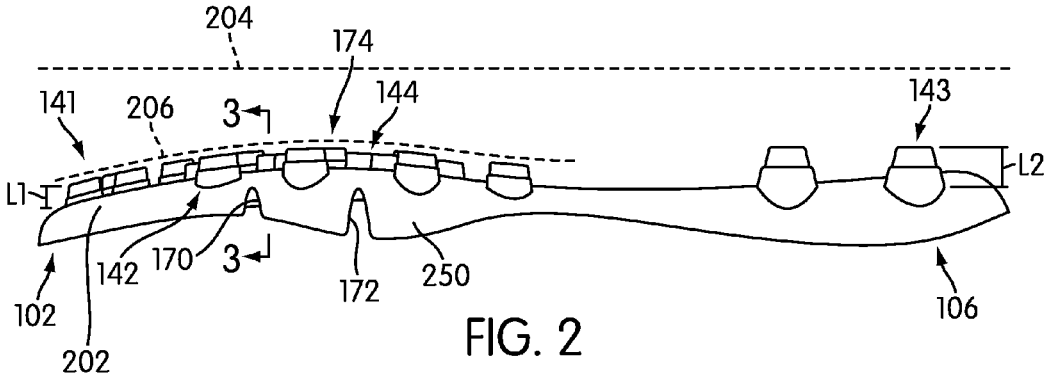
FIG. 2 is a side view of a preferred embodiment of an outsole with a cleat system.

Referring to FIG. 2, the lengths associated with each of the cleat groups 141-144 may vary. Here, length is measured from the base of a cleat to the tip of the cleat. Preferably, each cleat of first cleat group 141 and second cleat group 142 has a first length L1. Likewise, each of the cleats 122-125 of third cleat group 143 preferably has a second length L2, where L2 is preferably larger than L1.

Figure 3:
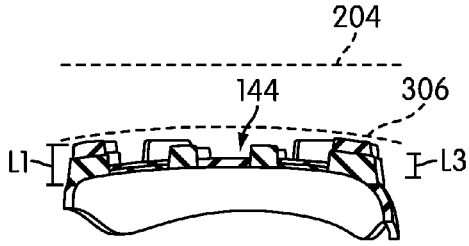
FIG. 3 is a cross sectional view of a preferred embodiment of an outsole with a cleat system.
Figure 4:
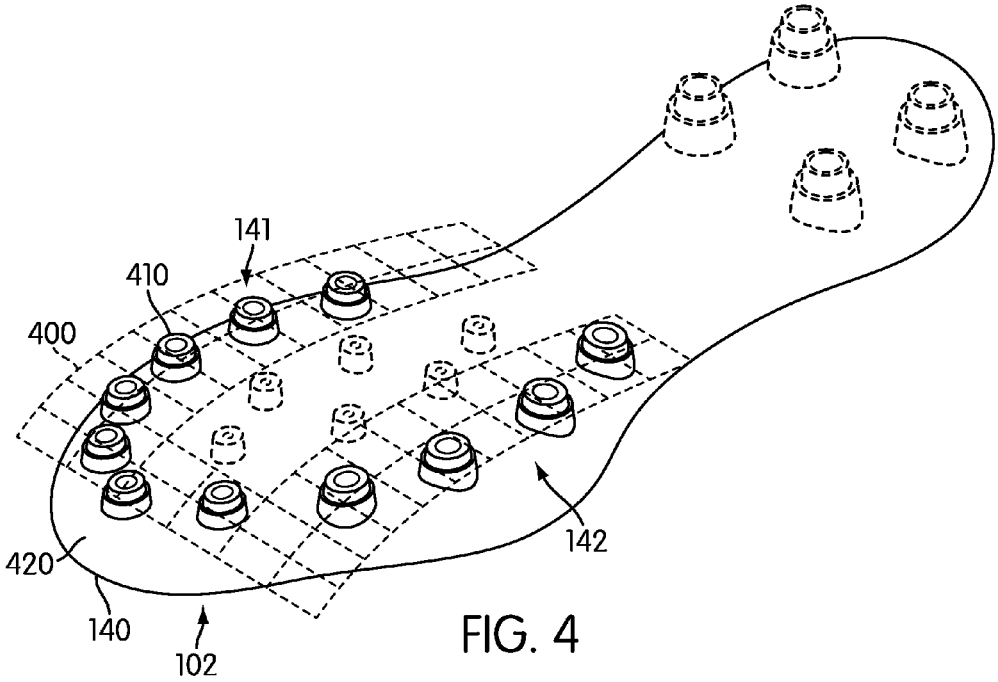
FIG. 4 is an isometric view of a preferred embodiment of an outsole with a cleat system.
Figure 5:
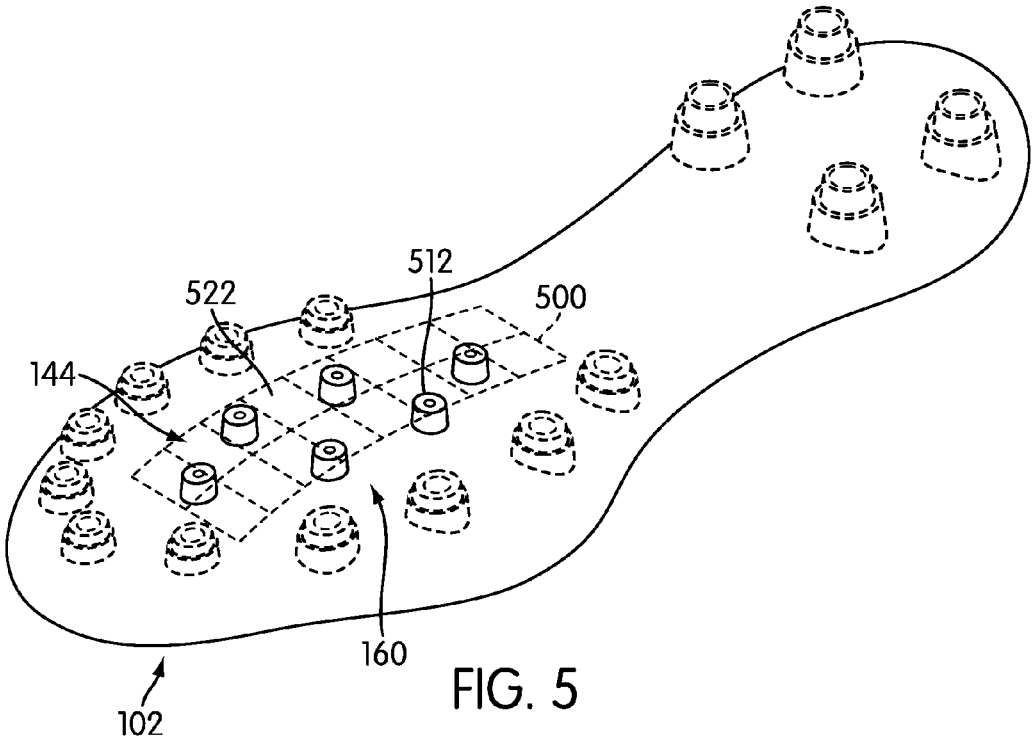
FIG. 5 is an isometric view of a preferred embodiment of an outsole with a cleat system.

Referring to FIG. 3, each cleat of fourth cleat group 144 preferably has a third length L3, where L3 is preferably smaller than L1. In other words, fourth cleat group 144 is preferably the shortest in length, while third cleat group 143, disposed along third portion 106, has the longest length. Generally, the length of first cleat group 141 and second cleat group 142 will be between the lengths of third cleat group 143 and fourth cleat group 144.

Using this configuration, stability is increased by raising third portion 106, which is preferably associated with the heel of the user's foot, furthest off a surface. Additionally, the difference in length between cleats associated with cleat groups 141-142 and the length of cleats associated with fourth cleat group 144 prevents fourth cleat group 144 from engaging with the ground until after a user's foot is planted.

Preferably, first portion 102 of outsole 100 may include provisions for preventing slipping of the foot towards the lateral side. In some embodiments, first portion 102 may include lateral wrapping 250. Lateral wrapping 250 is preferably a portion of outsole 100 that is angled with respect to outer surface 202 of outsole 100. With this configuration, lateral wrapping 250 preferably engages the lateral side of a user's foot and helps prevent injury due to translation of the foot away from its preferred position over forefoot portion 102.

In some embodiments, lateral wrapping 250 also preferably includes provisions for increased flexibility along first portion 102. In some embodiments, outsole 100 may include grooves configured to enhance bending along a region of first portion 102. In a preferred embodiment, lateral wrapping 250 may include first groove 170 and second groove 172. Using this configuration, first groove 170 and second groove 172 preferably define first bending region 174 of first portion 102. Preferably, first bending region 174 may be associated with a natural bend line in the foot. In this manner, first bending region 174 facilitates the natural motion of the foot during use of outsole 100.

Preferably, cleat system 110 includes provisions for enhanced stability along first portion 102 of outsole 100. In some embodiments, first portion 102 may include an outer surface that is curved. In a preferred embodiment, some cleat groups comprising cleat system 110 may also be associated with a curved surface.

Referring to FIGS. 2-5, outer surface 202 of first portion 102 and some cleat groups comprising cleat system 110 may be congruent. In some embodiments, outer surface 202 of first portion 102 may be curved with respect to planar surface 204. In a preferred embodiment, outer surface 202 may be congruent with contour 206 of outer surface 202. Additionally, in some embodiments, outer surface 202 of first portion 102 may be congruent with contour 306 along the width of outer surface 202. In other words, outer surface 202 of first portion 102 is curved along its length and its width, with respect to planar surface 204.

As cleat groups 141, 142 and 144 are disposed along outer surface 202, they may also be associated with some curvature. To facilitate the discussion of the curvature of cleat groups 141, 142 and 144 it is preferable to consider first cleat surface 400 and second cleat surface 500. Preferably, first cleat surface 400 is a two-dimensional surface that may be associated with first cleat group 141 and second cleat group 142, disposed along outer periphery 140 of first portion 102. The reason for discussing two separate cleat surfaces 400 and 500 is that cleat groups 141 and 142 are associated with a different length than fourth cleat group 144. For this reason, it is preferable to consider two distinct surfaces that are associated with different heights from outer surface 202 of outsole 100.

In some embodiments, first cleat surface 400 may be horseshoe shaped, corresponding to the horseshoe shaped layout of first cleat group 141 and second cleat group 142. Generally, first cleat surface 400 is defined by first cleat tips 410 of first cleat group 141 and second cleat group 142. In a similar manner, second cleat surface 500 is a two-dimensional surface that may be associated with fourth cleat group 144, disposed along inner region 160 of first portion 102. Second cleat surface 500 may be defined by second cleat tips 512 of fourth cleat group 144.

Preferably, first surface 400 may be substantially congruent to peripheral surface 420 of outer surface 202. In other words, if first surface 400 is displaced so that it is disposed along peripheral surface 420, the two surfaces will substantially coincide. In a similar manner, second surface 500 may be preferably congruent to inner surface 522 of outer surface 202. In other words, if second surface 500 is displaced so that it is disposed along inner surface 522, the two surfaces will substantially coincide.

Using this configuration, additional stability is gained over cleats with tips that are associated with flat surfaces. Traditional cleats terminate in a pinpoint, so the available surface area for contact with a flat surface is low. Cleats according to the invention have a flattened surface to increase the surface area of the termination of the cleat. Therefore, the available surface area for contact with a flat surface is advantageously increased.

Preferably, cleat system 110 may include provisions for increasing traction with a surface. Referring to FIG. 1, cleats 111-131 of cleat system 110 may include indentations 180. In some embodiments, these indentations may associated with a spherical shape. In this manner, cleats 111-131 including indentations 180 may interact with a surface by grabbing the surface.

Figure 6:
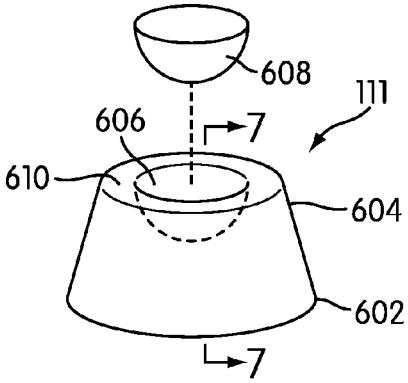
FIG. 6 is an isometric view of a preferred embodiment of a cleat.

FIG. 6 is an isolated isometric view of a preferred embodiment of first cleat 111. In some embodiments, cleat 111 may include base portion 602 and tip portion 604. Preferably, tip portion 604 may include indentation 606. In a preferred embodiment, first indentation 606 may be associated with a spherical shape. In particular, the geometry of first indentation 606 may be defined by considering an initially solid tip portion 604 with partial sphere 608 removed. Here, partial sphere 608 is shown for purposes of visualizing the geometry of indentation 606 only. Generally, indentation 606 may be formed through a molding process and not by the removal of a portion of a solid tip.

Figure 7:
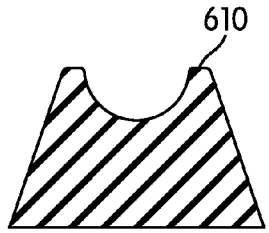
FIG. 7 is a cross sectional view of a preferred embodiment of a cleat.
Figure 8:
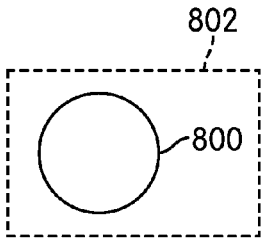
FIG. 8 is a plan view of a preferred embodiment of a ring of contact between a cleat and a planar surface.

In some embodiments, tip portion 604 includes rim 610. Generally, rim 610 may be rounded, as seen in FIG. 7. Preferably, only a small area of rim 610 may be configured to touch a surface. Ring 800, seen in FIG. 8, represents the region of contact between rim 610 and surface 802, as viewed from below. In other words, if rim 610 is covered in ink and then pressed down on a flat surface, ring 800 will be the mark left by first rim 610.

In the previous embodiments, cleats 112-131 (see FIG. 1) of cleat system 110 preferably include a structure similar to first cleat 111. In particular, each of the cleats 112-131 preferably includes a base portion and a tip portion. Each tip portion preferably includes a spherically indented portion.

In some embodiments, properties such as the shape of the rim may be varied. In some embodiments, the shape of the rim may be flat, as opposed to rounded. In a preferred embodiment, the region of contact between a cleat with a flat rim and a planar surface is larger than the region of contact discussed for the previous embodiment.

Figure 9:
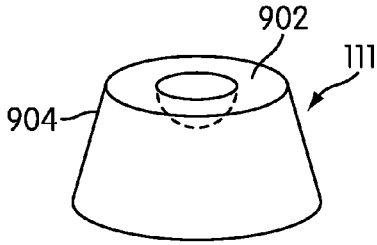
FIG. 9 is an isometric view of a preferred embodiment of a cleat.
Figure 10:
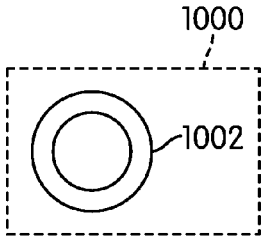
FIG. 10 is a plan view of a preferred embodiment of a ring of contact between a cleat and a planar surface.

FIG. 9 is an alternative embodiment of first cleat 111. In this embodiment, first cleat 111 includes flat rim 902, disposed along tip portion 904. The region of contact between cleat 111 and surface 1000 is depicted in FIG. 10 as ring 1002. In other words, if rim 902 is covered in ink and then pressed down on a flat surface, ring 1002 will be the mark left by flat rim 1002. With this configuration, flat rim 902 may help provide tip portion 904 with more traction along a flat surface.

In other embodiments, the overall shape of indentation 606 may be varied. In some embodiments, the radius of curvature of indentation 606 may be varied. In some embodiments, the height of indentation 606 may be varied. Additionally, the width and radius of curvatures associated with rim 610 may be varied.

Figure 11:
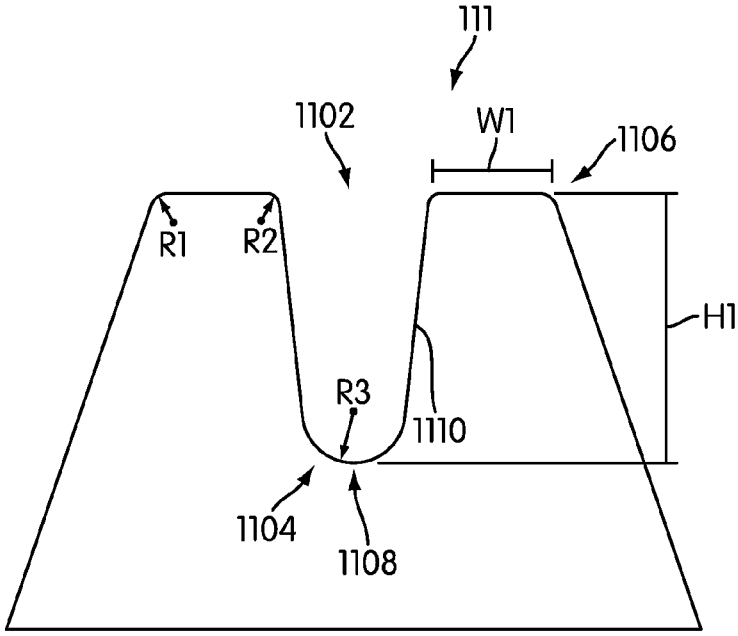
FIG. 11 is a cross sectional view of a preferred embodiment of a cleat.
Figure 12:
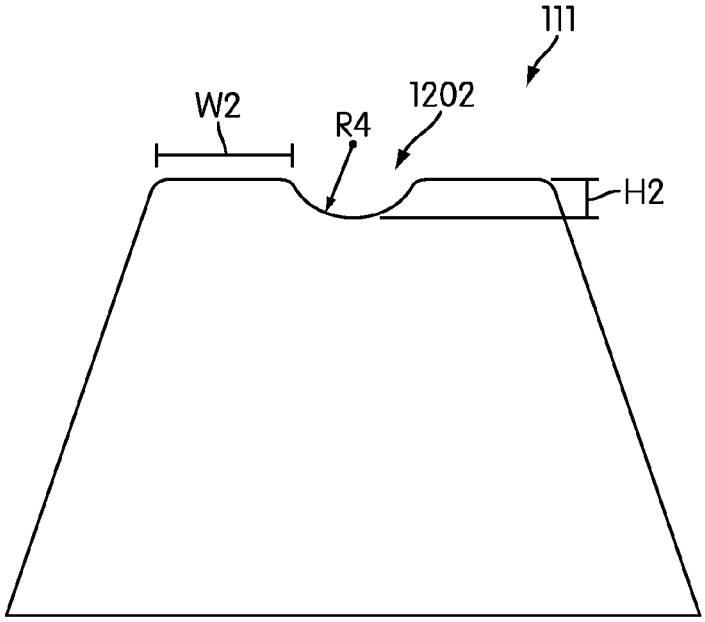
FIG. 12 is a cross sectional view of a preferred embodiment of a cleat.
Figure 13:
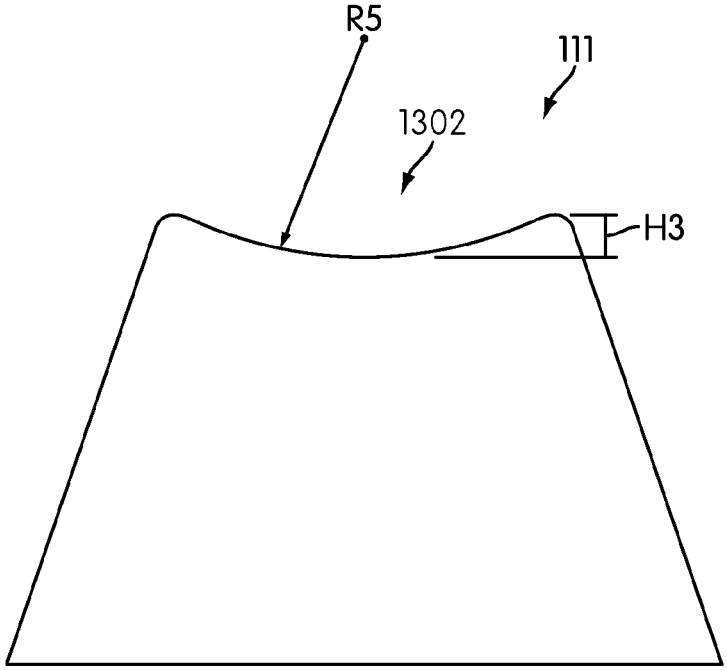
FIG. 13 is a cross sectional view of a preferred embodiment of a cleat.

Various embodiments of first cleat 111 may be seen with reference to FIGS. 11-13. In some embodiments, first cleat 111 may include first indentation 1102. In some embodiments, first indentation 1102 may be associated with radius of curvature R3. Additionally, first indentation 1102 may be associated with height H1. Generally, height H1 is the distance between first rim 1106 and indentation base 1108.

In some embodiments, first rim 1106 may also be associated with width W1. Additionally, first rim 1106 may be associated with some curvature. In this embodiment, first rim 1106 may be associated with radius of curvature R1 and radius of curvature R2.

Preferably, the parameters described here, including radius of curvature R1, radius of curvature R2, radius of curvature R3, height H1 and width W1 define the geometry of first rim 1106 and first indentation 1102 of first cleat 111. In other embodiments, these parameters may be varied to change the geometry of the tip of first cleat 111. In some embodiments, height H1 may be changed to make first indentation 1102 more shallow or deeper, for example. Generally, each of these parameters R1, R2, R3, H1 and W1 may be varied.

Referring to FIGS. 12-13, first cleat 111 may include second indentation 1202 and third indentation 1302. Preferably, second indentation 1202 may be constructed with radius of curvature R4. In this manner, second indentation 1202 may be small and deep, while width W2 may be large. Preferably, third indentation 1302 may be constructed with radius of curvature R5. In general, radius of curvature R5 is larger than radius of curvature R4. Here, third indentation 1302 may be large and shallow. By varying the geometry of first cleat 111 in this manner, the amount of traction applied by gripping the surface may be varied.

These embodiments are only meant to be illustrative of the possible sizes of rims and indentations of a cleat. Generally, cleats with indentations may be constructed to any proportions. Additionally, although the indentations have been shown to be somewhat spherical, other embodiments may include square indentations, rectangular indentations, triangular indentations, as well as indentations of any other shape.

The indentations provide an advantage over traditional pointed cleats when walking on smooth or slick surfaces, such as the floor of a locker room. In traditional cleats, the points of the cleat provide the only surface area contact between the athlete and the floor. Because the athlete is essentially walking on points, maneuvering on a smooth floor may be hazardous, as traction is low and the likelihood of slipping and falling is increased. However, cleats according to the invention have rims and indentations to increase the surface area of contact between the floor and the cleat. The athlete is no longer walking on pinpoints, but is walking on the flat surface of the rim. This configuration increases traction between the athlete and the floor and decreases the likelihood of slipping and falling on a smooth or slick surface.

Figure 14:
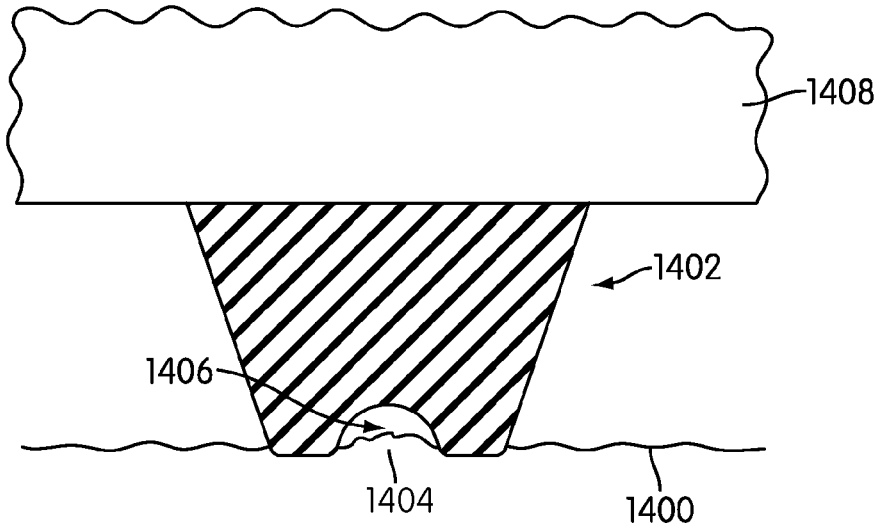
FIG. 14 is a cross sectional view of a preferred embodiment of a cleat.

FIG. 14 is a preferred embodiment of a portion of outsole 1408 including indented cleat 1402 in contact with surface 1400. In this embodiment, surface 1400, may slightly deform under pressure from indented cleat 1402. As surface 1400 deforms, first portion 1404 may be disposed within indentation 1406. In this manner, indented cleat 1402 preferably grips surface 1400, allowing indented cleat 1402 to facilitate traction with surface 1400. In general, surface 1400 may be any kind of surface, including both natural and artificial surfaces.

Preferably, an outsole with a cleat system may include cleats with indentations that vary over the outsole. In some embodiments, different groups of cleats may include different sized indentations. In a preferred embodiment, the outsole may include four different cleat groups, each associated with a different sized indentation.

Figure 15:
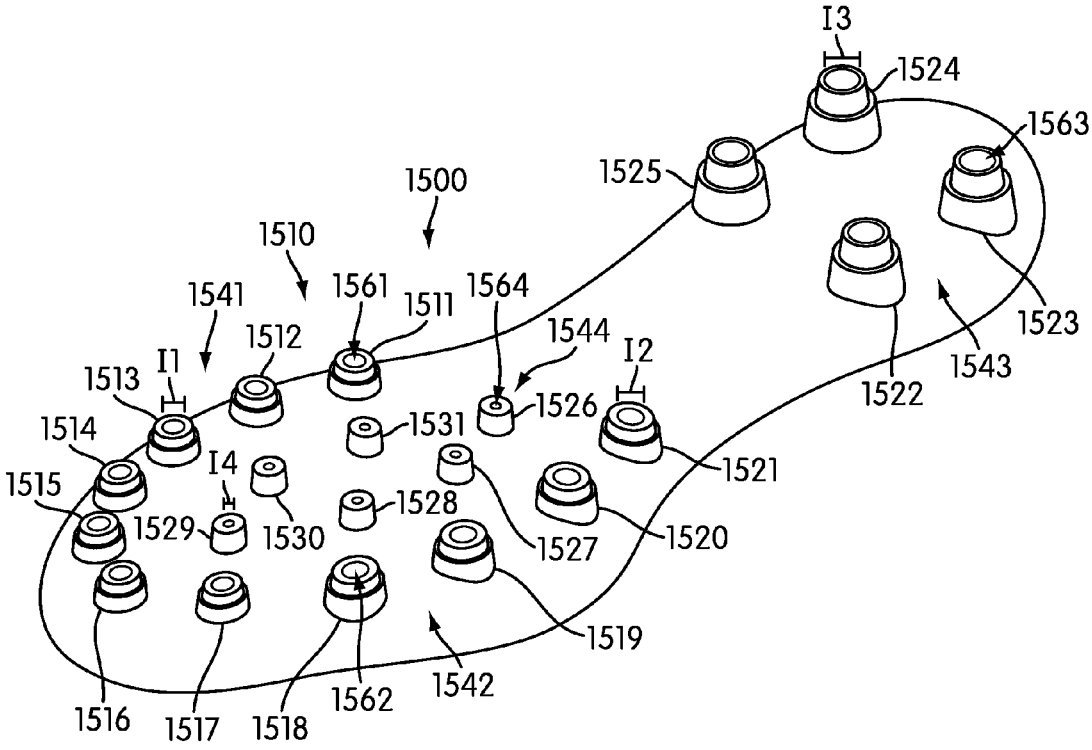
FIG. 15 is an isometric view of a preferred embodiment of an outsole with a cleat system.

FIG. 15 is an isometric view of a preferred embodiment of outsole 1500. In some embodiments, outsole 1500 may include cleat system 1510. In some embodiments, cleat system 1510 may include first cleat group 1541, including cleats 1511-1517. Additionally, cleat system 1510 may include second cleat group 1542, including cleats 1518-1521. In some embodiments, cleat system 1510 may include third cleat group 1543, including cleats 1522-1525. Finally, in some embodiments, cleat system 1510 may include fourth cleat group 1544, including cleats 1526-1531.

Preferably, each of the cleat groups 1541-1544 may be associated with indentations. In some embodiments, first cleat group 1541 may be associated with first indentations 1561. In some embodiments, second cleat group 1542 may be associated with second indentations 1562. In some embodiments, third cleat group 1543 may be associated with third indentations 1563. Additionally, fourth cleat group 1544 may be associated with fourth indentations 1564.

Generally, the sizes of indentations 1561-1564 may vary. First indentations 1561 may be associated with indentation diameter I1. Likewise, second indentations 1562 may be associated with indentation diameter I2. In some embodiments, third indentations 1563 may be associated with indentation diameter I3. Finally, fourth indentations 1564 may be associated with indentation diameter I4. Generally, indentation diameter I4 is the smallest, with the diameters being ordered in ascending sizes as: I4, I1, I2, I3. Using this configuration, the traction applied by cleat system 1510 may be varied along each of the cleat groups 1541-1544.

Preferably, an outsole with a cleat system may include provisions for supplying internal structure along the outsole. In some embodiments, the outsole may include an internal structural plate. In some embodiments, the internal structural plate may be disposed along the length of the outsole. Preferably, the internal structural plate may include provisions for minimizing the pressure applied by the cleat system during use.

Figure 16:
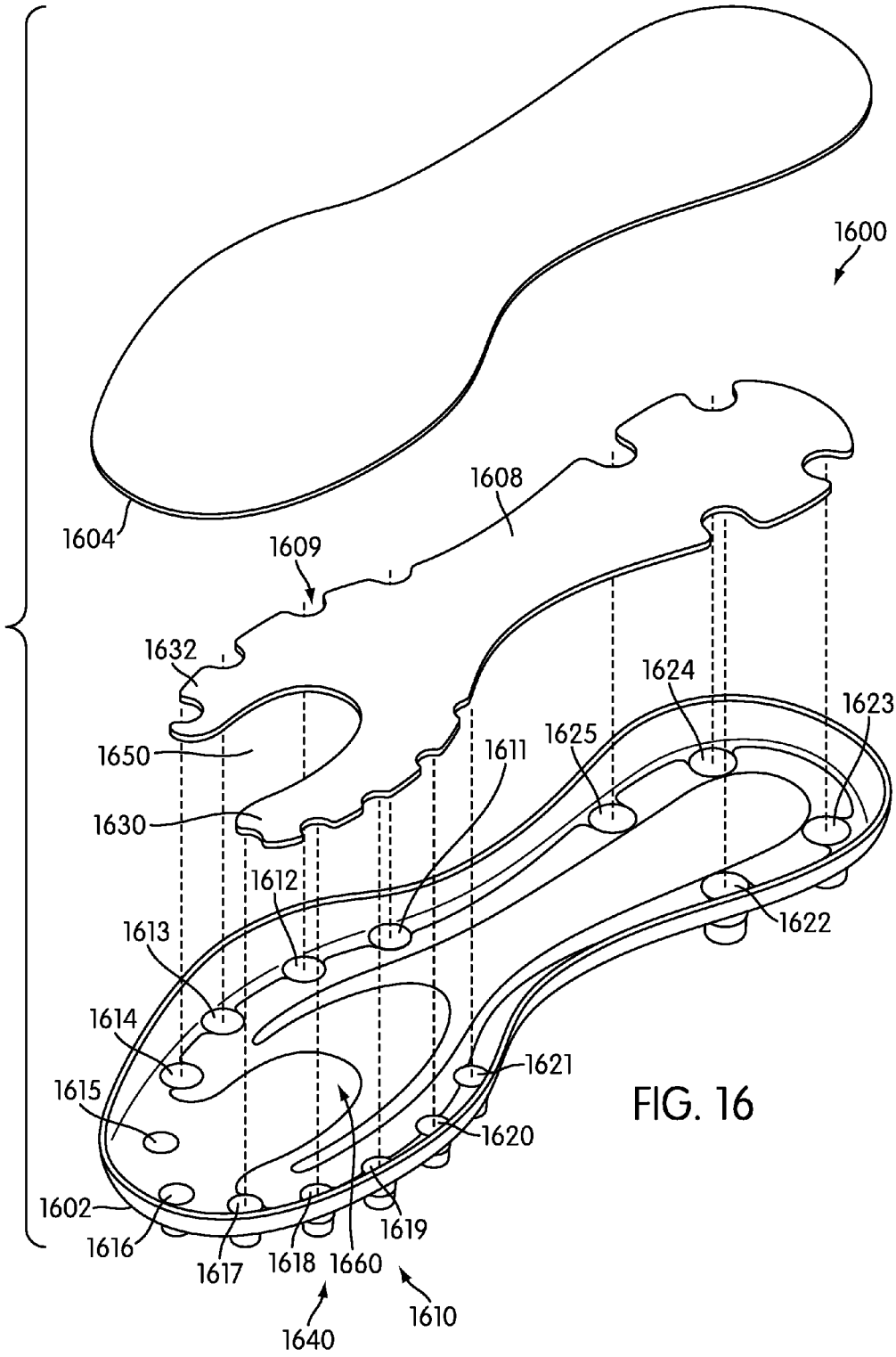
FIG. 16 is an exploded isometric view of a preferred embodiment of an outsole with an internal structural plate.

FIG. 16 is an exploded isometric view of a preferred embodiment of outsole 1600. Generally, outsole 1600 includes bottom portion 1602 associated with cleat system 1610, while top portion 1604 may be associated with a midsole or insole. Preferably, top portion 1604 may be disposed closer to a user's foot than bottom portion 1602.

In some embodiments, internal structural plate 1608 may be disposed between bottom portion 1602 and top portion 1604 of outsole 1600. Preferably, top portion 1604 and bottom portion 1602 are constructed as a single material that encases internal structural plate 1608. In a preferred embodiment, outsole 1600 may be constructed of a material that is molded around internal structural plate 1608.

Generally, internal structural plate 1608 may be a flex plate of some kind. In some embodiments, internal structural plate 1608 may be constructed of a material with a high rigidity. In some embodiments, internal structural plate 1608 may be constructed of a material with good response and some energy return. In a preferred embodiment, internal structural plate 1608 may be constructed of a nylon material with a glass fill.

The preferred positions of cleats 1611-1625 are shown along bottom portion 1602. Preferably, internal structural plate 1604 includes notches 1609 that are associated with cleats 1611-1614 and cleats 1617-1625. Notches 1609 are preferably configured in a manner that prevents any overlap between cleat system 1610 and internal structural plate 1608. This configuration prevents any cleat from cleat system 1610 from pressing against internal structural plate 1604 and creating undesired tension along outsole 1600.

Additionally, internal structural plate 1604 preferably includes provisions for facilitating flexibility along first portion 1640 of outsole 1600. In particular, internal structural plate 1604 preferably includes first extension 1630 and second extension 1632. Generally, first extension 1630 may be associated with a user's toes, and in particular the big toe. In a preferred embodiment, first extension 1630 may support the big toe. With this configuration, first extension 1630 may preferably prevent the big toe from undergoing hyperextension. Second extension 1632 may also be associated with a user's toes. Internal structural plate 1604 may also include gap 1650, disposed between first flange 1630 and second flange 1632.

The configuration of first flange 1630 and second flange 1632 along first portion 1640 of outsole 1600 preferably allow for increased flexibility along bending region 1660. Additionally, this configuration helps to prevent hyperextension of the user's foot in along first portion 1640. In this manner, internal structural plate 1604 preferably provides built-in turf toe protection.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear including an outsole, comprising:

the outsole including a forefoot portion, a heel portion, a medial side, a lateral side, an edge, and an outwardly facing outer surface;

the outsole including a length from a first edge portion at a front of the forefoot portion to a second edge portion at a rear of the heel portion;

the outsole including a width from a third edge portion on the lateral side of the outsole to a fourth edge portion on the medial side of the outsole;

a first group of cleats disposed on the outer surface of the outsole, each cleat of the first group of cleats including a first base portion and a first tip portion and having a first height extending from the first base portion to the first tip portion each cleat defining a longitudinal axis from the base portion to the tip portion; and a second group of cleats disposed on the outer surface of the outsole, each cleat of the second group of cleats including a second base portion and a second tip portion and having a second height extending from the second base portion to the second tip portion each cleat defining a longitudinal axis from the base portion to the tip portion;

wherein the first base portion has a first base diameter and the second base portion has a second base diameter;

wherein the second base diameter is larger than the first base diameter;

wherein the forefoot portion includes a medial area, a lateral area, and an central area disposed between and separating the medial area and the lateral area;

wherein the first group of cleats comprises a majority of cleats in the medial area;

wherein a majority of the first group of cleats are spaced from the edge a distance less than the first base diameter;

wherein the second group of cleats comprises a majority of cleats in the lateral area; and wherein a majority of the second group of cleats are spaced from the edge a distance less than the second base diameter.

2. The article of footwear according to claim 1, wherein the first group of cleats includes about seven cleats and the second group of cleats includes about four cleats.

3. The article of footwear according to claim 1, further comprising:

a third group of cleats disposed in the heel portion, each cleat of the third group of cleats including a third base portion and a third tip portion and having a third height from the third base portion to the third tip portion, wherein the third base portion has a third base diameter that is larger than the second base diameter, wherein the third height is larger than the first height and the second height, and wherein the third group of cleats comprises a majority of cleats in the heel portion.

4. The article of footwear according to claim 3, further comprising:

a fourth group of cleats disposed in the central area, each cleat of the fourth group of cleats including a fourth base portion and a fourth tip portion and having a fourth height from the fourth base portion to the fourth tip portion, wherein the fourth base portion has a fourth base diameter that is smaller than the first base diameter, wherein the fourth height is smaller than the first height and the second height, and wherein the fourth group of cleats comprises a majority of the cleats in the central area.

5. The article of footwear according to claim 1, wherein the medial area includes the first group of cleats and excludes the second group of cleats, and the lateral area includes the second group of cleats and excludes the first group of cleats.

6. The article of footwear according to claim 4, wherein the medial area includes the first group of cleats and excludes the second group of cleats, the lateral area includes the second group of cleats and excludes the first group of cleats, the third group of cleats lies solely in the heel portion, and the fourth group of cleats lies solely in the central area.

7. The article of footwear according to claim 1, wherein each cleat of the first group of cleats includes a first indentation and each cleat of the second group of cleats includes a second indentation;

wherein the first indentation has a first diameter and the second indentation has a second diameter that is larger than the first diameter.

8. The article of footwear according to claim 1, wherein the first group of cleats includes four cleats in the medial area and three cleats in a front toe portion.

9. An article of footwear including an outsole, comprising:

the outsole including a forefoot portion, a heel portion, a medial side, a lateral side, an outsole edge, and an outwardly facing outer surface;

the outsole defining a length from a first outsole edge portion at a front of the forefoot portion to a second outsole edge portion at a rear of the heel portion;

the outsole defining a width from a third outsole edge portion on the lateral side of the outsole to a fourth outsole edge portion on the medial side of the outsole;

at least one cleat disposed on the outer surface of the outsole, the cleat including a base and a tip, having a first height extending from the base to the tip, and defining a longitudinal axis from the base to the tip;

an internal structural plate disposed along the outsole;

wherein the internal structural plate includes an internal structural plate edge;

wherein the internal structural plate includes a lengthwise axis from a rear internal structural plate edge portion to a front internal structural plate edge portion;

wherein the internal structural plate includes a widthwise axis from a lateral internal structural plate edge portion to a medial internal structural plate edge portion;

wherein the internal structural plate includes at least one notch disposed on the internal structural plate edge;

wherein the at least one notch forms a hollow space along the internal structural plate edge;

wherein the outsole is made of a first material and the internal structural plate is made of a second material;

wherein the second material has a different rigidity that the first material; and wherein at least a portion of the base of the at least one cleat is disposed within the notch.

10. The article of footwear according to claim 9, wherein multiple cleats are disposed along the outer surface, each cleat of the multiple cleats including a base and a tip and defining a longitudinal axis from the base to the tip;

wherein the internal structural plate includes multiple notches along the internal structural plate edge;

wherein each notch is associated with the base of a corresponding cleat; and wherein at least a portion of the base of the corresponding cleat is disposed within the notch when viewed in the direction along the longitudinal axis of the corresponding cleat.

11. The article of footwear according to claim 10, wherein the internal structural plate defines a contour of the notch when viewed in the direction along the longitudinal axis of the corresponding cleat; and wherein a contour of the base portion of the corresponding cleat is aligned with the contour of the notch when viewed in the direction along the longitudinal axis of the corresponding cleat.

12. The article of footwear according to claim 9, wherein the internal structural plate comprises carbon fiber.

13. The article of footwear according to claim 9, wherein the internal structural plate comprises nylon with a glass fill.

14. An article of footwear including an outsole, comprising:

an internal structural plate disposed along a length of the outsole;

wherein the outsole includes a front toe portion and a rear heel portion a medial side, a lateral side, an edge, and an outwardly facing outer surface, the outsole defining a length from a first edge portion at a front of the front toe portion to a second edge portion at a rear of the rear heel portion;

the outsole defining a width from a third edge portion on the lateral side of the outsole to a fourth edge portion on the medial side of the outsole;

wherein the internal structural plate defines a lengthwise axis from a rear edge portion to a front edge portion;

wherein the internal structural plate defines a widthwise axis from a lateral edge portion to a medial edge portion;

the outsole including a lateral wrapping portion configured to engage a lateral side of a foot;

wherein the lateral wrapping portion includes a first groove and a second groove, wherein the second groove lies closer to the front toe portion than the first groove;

wherein the outsole includes a bending region associated with a natural bend line in a foot;

wherein the bending region lies lengthwise between the first groove and the second groove;

wherein the bending region is adjacent to a rear border of the front toe portion;

wherein the internal structural plate includes a medial projecting portion and a lateral projecting portion that define a gap between them;

wherein the lateral projecting portion extends in the lengthwise axis from the bending region to the front toe portion;

wherein the medial projecting portion extends in the lengthwise axis from the bending region to the front toe portion;

wherein the medial projecting portion extends farther forward into the toe portion than the lateral projecting portion; and a rearmost portion of the gap lies in the bending region.

15. The article of footwear according to claim 14, further comprising at least one cleat disposed along an outer surface of the outsole, the at least one cleat including a base and a tip and defining a longitudinal axis from the base to the tip;

wherein the internal structural plate includes at least one notch along a periphery of the internal structural plate; and wherein at least a portion of the base of the at least one cleat is disposed within the notch when viewed in a direction along the longitudinal axis.

16. The article of footwear according to claim 15, wherein multiple cleats are disposed along the outer surface, each cleat of the multiple cleats including a base and a tip and defining a longitudinal axis from the base to the tip;

wherein the internal structural plate includes multiple notches along the periphery of the internal structural plate;

wherein each notch is associated with the base of a corresponding cleat; and wherein at least a portion of the base of the corresponding cleat is disposed within the notch when viewed in the direction along the longitudinal axis of the corresponding cleat.

17. The article of footwear according to claim 16, wherein the internal structural plate defines a contour of the notch when viewed in the direction along the longitudinal axis of the corresponding cleat; and wherein a contour of the base portion of the corresponding cleat is aligned with the contour of the notch when viewed in the direction along the longitudinal axis of the corresponding cleat.

18. The article of footwear according to claim 15, wherein each of the at least one cleat includes an indentation along the tip.

19. The article of footwear according to claim 18, wherein the indentation is spherical.

20. The article of footwear according to claim 14, wherein the internal structural plate comprises carbon fiber.

* * * * *